United States Patent [19]

Reemtsema et al.

[11] Patent Number: 4,986,707

[45] Date of Patent: Jan. 22, 1991

[54] RAILROAD FREIGHT CAR

[75] Inventors: Karl-Dieter Reemtsema, Minden/Westfalen; Peter Wackermann, Wunsdorf; Guenter Ahlborn, Siegen; Gerhard Kampmann, Netphen, all of Fed. Rep. of Germany

[73] Assignee: Waggon Union GmbH, Siegen, Fed. Rep. of Germany

[21] Appl. No.: 378,404

[22] Filed: Jul. 10, 1989

[30] Foreign Application Priority Data

Jul. 8, 1988 [DE] Fed. Rep. of Germany ..... 3823208

[51] Int. Cl.[5] ..... B61D 39/00; F16B 39/24

[52] U.S. Cl. ..... 410/132; 105/377

[58] Field of Search ..... 410/129, 130, 132, 133, 410/134, 135, 137, 138, 139, 140, 141; 105/363, 377, 379

[56] References Cited

U.S. PATENT DOCUMENTS

| | | | |
|---|---|---|---|
| 1,215,892 | 2/1917 | Watts | 410/133 |
| 2,227,807 | 1/1941 | Dixon | 410/132 |
| 2,324,721 | 7/1943 | Connor | 410/130 |
| 2,725,827 | 12/1955 | Wehby | 410/130 |
| 2,974,612 | 3/1961 | Stough | 410/132 |
| 3,324,595 | 6/1967 | Loomis | 410/137 |
| 3,369,502 | 2/1968 | Breen et al. | 410/133 |
| 4,569,293 | 2/1986 | Kramer et al. | 105/377 |

FOREIGN PATENT DOCUMENTS

| | | | |
|---|---|---|---|
| 2633864 | 7/1976 | Fed. Rep. of Germany . | |
| 2649991 | 10/1976 | Fed. Rep. of Germany . | |
| 2752635 | 11/1977 | Fed. Rep. of Germany . | |
| 3312001 | 4/1983 | Fed. Rep. of Germany . | |
| 3403707 | 2/1984 | Fed. Rep. of Germany . | |
| 3422041 | 12/1985 | Fed. Rep. of Germany | 410/129 |
| 1036601 | 9/1981 | U.S.S.R. . | |

*Primary Examiner*—Robert P. Olszewski
*Assistant Examiner*—Mark T. Le
*Attorney, Agent, or Firm*—McGlew and Tuttle

[57] ABSTRACT

The invention relates to a railroad freight car having hoods covering the freight room which slide over each other and lie in one plane in the closed position. The hoods are liftable, swivelable and can be put down on rollers which engage rails by means of an actuation arrangement. The hoods, are split at their apex where they have joints and a sealing element. The railroad freight car is provided with separation walls for securing of a load. The separation walls, are movable on rollers running in rails on the freight floor, on both sides of the center portal in the freight floor and can be arrested at the bottom by releasable pegs in the floor and at the top by means of swivelable locking cams in the hood.

9 Claims, 6 Drawing Sheets

RAILROAD FREIGHT CAR

FIELD OF THE INVENTION

The invention relates to a railroad freight car having side walls, a fixedly arranged central portal, a preferably level freight floor and hoods covering the freight room which lie in one plane in the closed position. The hoods are liftable, swivelable and can be connected to rollers which may be placed onto rails by means of an actuation means. The hoods, which are split at their apex where they have joints and a sealing means, can be slid over one another.

BACKGROUND OF THE INVENTION

Such railroad freight cars are known from DE-OS 33 12 001. According to this reference, hoods covering the freight room can alternatively be lifted and moved over the portal and the hood which is in the closed position. The room inside the structure gauge can be used optimally as freight storage space. In the closed position of the hoods an automatic cramping of the hoods with the face walls, the center portal and the bogie takes place. Thus the main freight pressure acting upon the end walls due to a buffer stroke is transferred to the bogie of the freight car by means of the hoods. The design of the hoods integrated as carrying elements in the freight car body is advantageous railroad freight car, construction and is economically advantageous from a manufacturing standpoint.

In railroad freight cars having swivelable and slidable hoods the missing means for fastening separate stacks of goods or pallets in the freight room is disadvantageous.

DE-PS 26 33 864, DE-PS 26 49 991, DE-PS 27 52 635 and DE-OS 34 03 707 teach the arrangements of movable separation walls in closed freight cars with fixedly mounted lengthwise head arches which can be arrested in any desired location in the car with their top in the lengthwise head arches of the freight car body and on the bottom of the freight room by means of pegs in a punched strip. The movable separation walls are suspended from rails in the lengthwise head arches by means of rollers and can be moved freely in the head arch rails of the freight car once the locking pegs have been released.

Such known separation walls, however, cannot be used in a railroad freight car of the kind mentioned initially, as the lengthwise head arches for the locking of the separation walls are missing.

SUMMARY AND OBJECTS OF THE INVENTION

It is an object of the invention to provide a railroad freight car of the kind mentioned above which can be equipped with separation walls for the securing of the freight, and to design the separation walls so that they can be moved freely in the unlocked state and take up as little space as possible when they are slid together, and to coordinate railroad freight cars and separation walls so that the secure locking and unlocking of the separation walls and the secure lifting or closing of the various hoods are guaranteed.

This task is solved according to the invention in that separation walls, which are movable on rollers running in rails on the floor, are arranged on both sides of the center portal in the freight room and can be arrested at the bottom by means of releasable pegs in the floor and at the top by means of swivelable locking cams in the hood. The invention allows for the use of the separation walls which have proven successful in closed railroad freight cars with lengthwise head arches in railroad freight cars of the kind mentioned initially. Due to the fact that the rollers are arranged on rails on the floor and that they carry the separation walls, the separation walls can be moved freely in the freight room. A system similar to the time-tested system of pegs which can be inserted in the floor is used for the locking of the bottom of the separation walls, while the locking of the top of the separation walls is executed directly in the hood.

The lengthwise sides of the freight floor have the shape of a C-profile with a downward-pointing opening for the reception of the rail for the separation walls, in which the rail receiving the rollers of the separation walls can be moved and adjusted transversely within limits. The arrangement and shape of the lengthwise sides of the freight floor as a C-profile open toward the bottom prevent the rails from becoming soiled clogging an damaged. The rails for the separation wall rollers can be moved and adjusted transversely within limits in the C-profiles. Rails which are transversely movable and adjustable within limits are advantageous with regard to the usual tolerances in railroads in order to ensure the easy movement of the separation wall rollers.

Each bottom of the transverse end of each separation wall has a rolling fixture receiving the rollers, each rolling fixture having four rollers, two each of which being arranged on an axle spaced apart with regard to one another, the axles of the roller pairs being arranged parallel and spaced apart with regard to one another and both axles having a common axle holder being fixedly and rigidly connected to each axle between the rollers of each roller pair. The axle holder grips laterally around the freight floor and is connected to the separation wall by means of elastic elements. The arrangement of two roller pairs on a common axle holder guarantees that the separation walls are stable and tilt-proof even in the unlocked position and also that they can be moved easily. The fastening of the axle holder on to the separation wall by means of elastic elements prevents the straining of the rollers or rails when a freight load sits close the separation walls and settles while the train is in motion. Preferably three separation walls are arranged on either side of the center portal, the rolling fixture of the middle separation wall being arranged vertically under the separation wall and the rolling fixtures of the outer separating walls being staggered and arranged on the separation walls symmetrical with regard to one another. Due to the rolling fixture arrangement on the separation walls the walls may be slid toward one another tightly in and a space-saving manner.

Locking strips are arranged in the area of the hood, retracted toward the lengthwise axis of the freight car, on the inside of each lengthwise side of each hood. The locking strips have vertical slots with upward-pointing taperings and are arranged next to one another, in a row, and at a distance with regard to one another. On the lengthwise sides of the freight floor punched strips with holes arranged at a distance with regard to one another are arranged on the inside of and next to the C-profile. Due to the arrangement of the locking strips in each hood, and the punched strips on the freight floor of the railroad freight car, the separation walls can be fastened fixedly on the freight floor and the hood may be fixed in any desired position.

The peg and the locking cam of each transverse end of each separation wall are actuated by means of an actuating lever system with handle embedded in the separation wall. The vertically movable pegs snap in the holes of the punched strip and the locking cam swivels upward into the slots of the locking strip from below. The locking cam has the shape of a double-sided lever and is swivelable around a horizontal axle arranged in the lengthwise direction of the car, the end of the locking cam protruding into the separation wall. The locking cam is articulatedly connected to the actuating lever system and the end of the locking cam protrudes laterally from the separation wall and is tapered and adjusted to the angle of the slot. It is also advantageous that the locking cam can be disengaged from its locked position against the force of a spring arranged in the lever system.

When fastening the separation walls while the hood is open, the peg is moved vertically downward into one of the holes of the punched strip and the locking cam is swiveled laterally outward from the separation wall by means of the handle and the actuating lever system. During the subsequent closing of the hood the locking cam is swiveled downward by means of the locking strip if no slot is located directly above a locking cam. Upon the first settling of the freight during a light buffing stroke the separation wall, which is secured at the bottom, is slightly moved at the top and the locking cam is moved into the next slot by means of centrifugal force and therefore the top of the separation wall is automatically fastened.

Accordingly, it is an object of the invention to provide a railroad freight car with separation walls which may be moved freely and which are easy to employ, economical to use, and economical to manufacture and which are simple and straight forward in design.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 6:
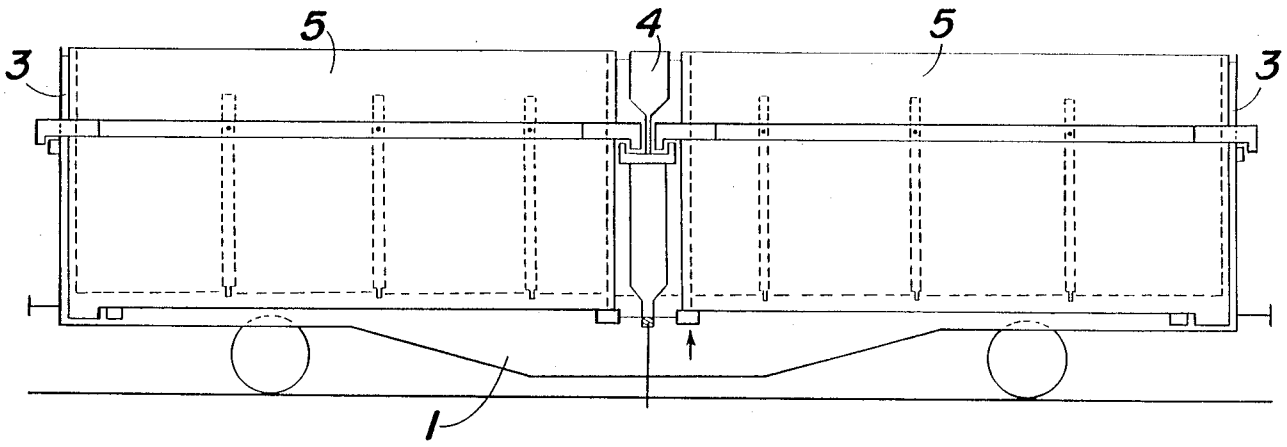
FIG. 6 is a lateral view of a railroad freight car according to the invention.

Referring to the drawings in particular, the invention embodied therein comprises a railroad freight car including a bogie 1 having a plain freight floor 2, end walls 3, a rigid center portal 4 and two hoods 5, covering the freight room (see FIG. 6). The bogie 1, draw gear, buffing gear and the other additional elements provided on a normal railroad freight car are not essential to the present invention and are therefore not discussed in detail.

The hoods 5 covering the freight room are parted at their apex where they have joints 6 and a sealing member. By means of an actuation means, which is not shown, the hoods can be lifted from their closed position into a sliding position. The hoods may be swiveled and deposited with their rollers on rails and slid over one another.

Three separation walls 7 are each arranged lengthwise movable on either side of the center portal in the freight room of the railroad freight car. Herein the separation walls 7 are arranged mounted in C-shaped rails 8 by means of rollers 10, the rails being laterally movable and adjustable within limits in C-profiles 9 open toward the bottom floor and arranged lengthwise on the freight floor 2. The open side of the rail 8 also points downward. For each transverse end of each separation wall four rollers 10 are provided, two each being arranged spaced apart on an axle 11. The axles 11 of the rollers 10 are arranged parallel and at a distance with regard to one another. Both axles 11 have a common axle holder 12 arranged between the rollers 10 of each roller pair. The axle holder 12 grips the freight floor 2 laterally and is connected to the separation wall 7 by means of elastic elements 13. The rollers 10, the axles 11, the axle holder 12 and the elastic element 13 form a rolling fixture which is to be prefabricated. The rolling fixture of the central separation wall 7 on each freight room side is arranged vertically under the separation wall 7 and the rolling fixtures of the outer separation walls 7 are arranged laterally staggered under the separation walls 7 and symmetrically with regard to one another. Punched strips 14 having holes 15 at a distance with regard to one another are arranged lengthwise in the railroad freight car on the inside of the C-profiles 9 of the freight floor 2 and next to the C-profiles 9.

Figure 1:
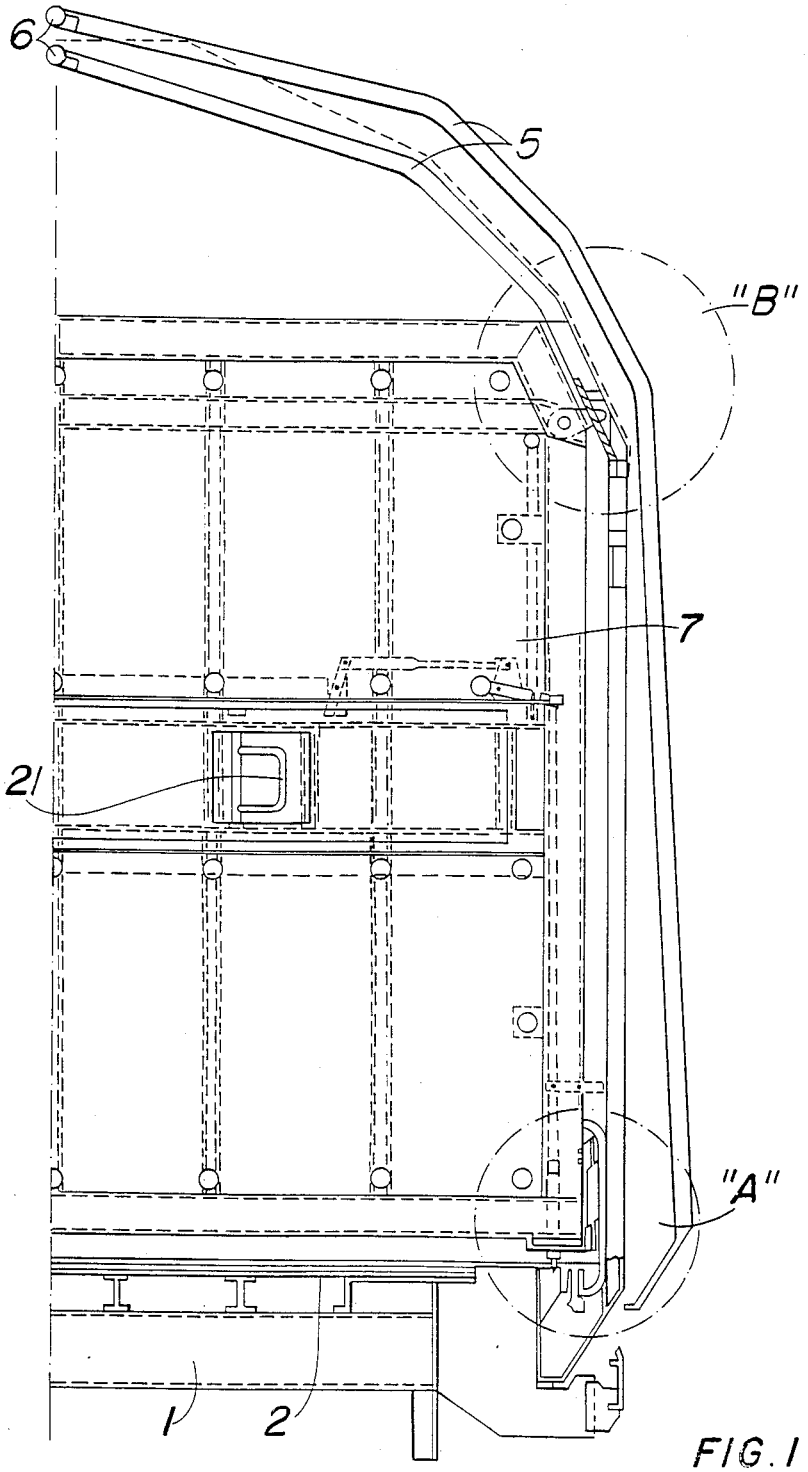
FIG. 1 is a lateral cross-sectional view of a railroad freight car according to the invention.
Figure 2:
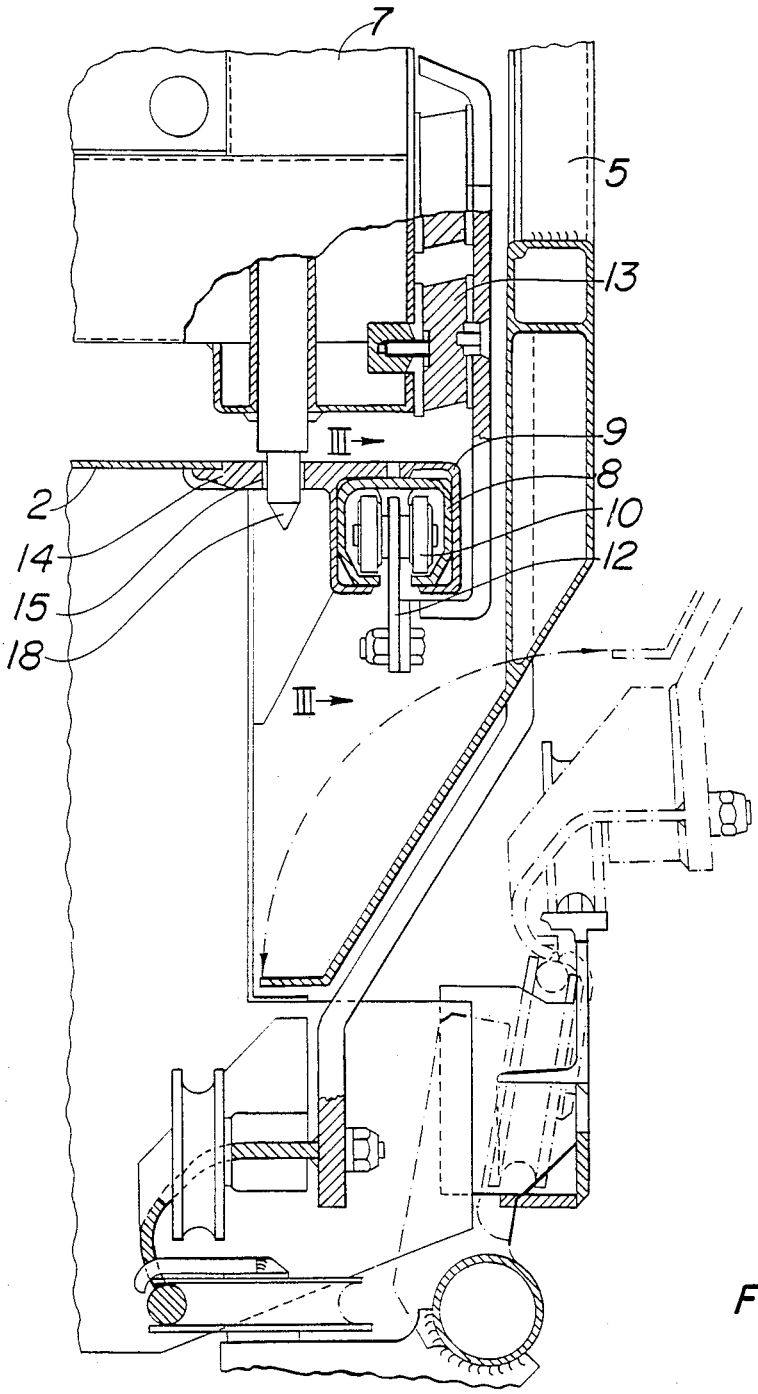
FIG. 2 is an enlarged view of the detail "A" of FIG. 1.
Figure 3:
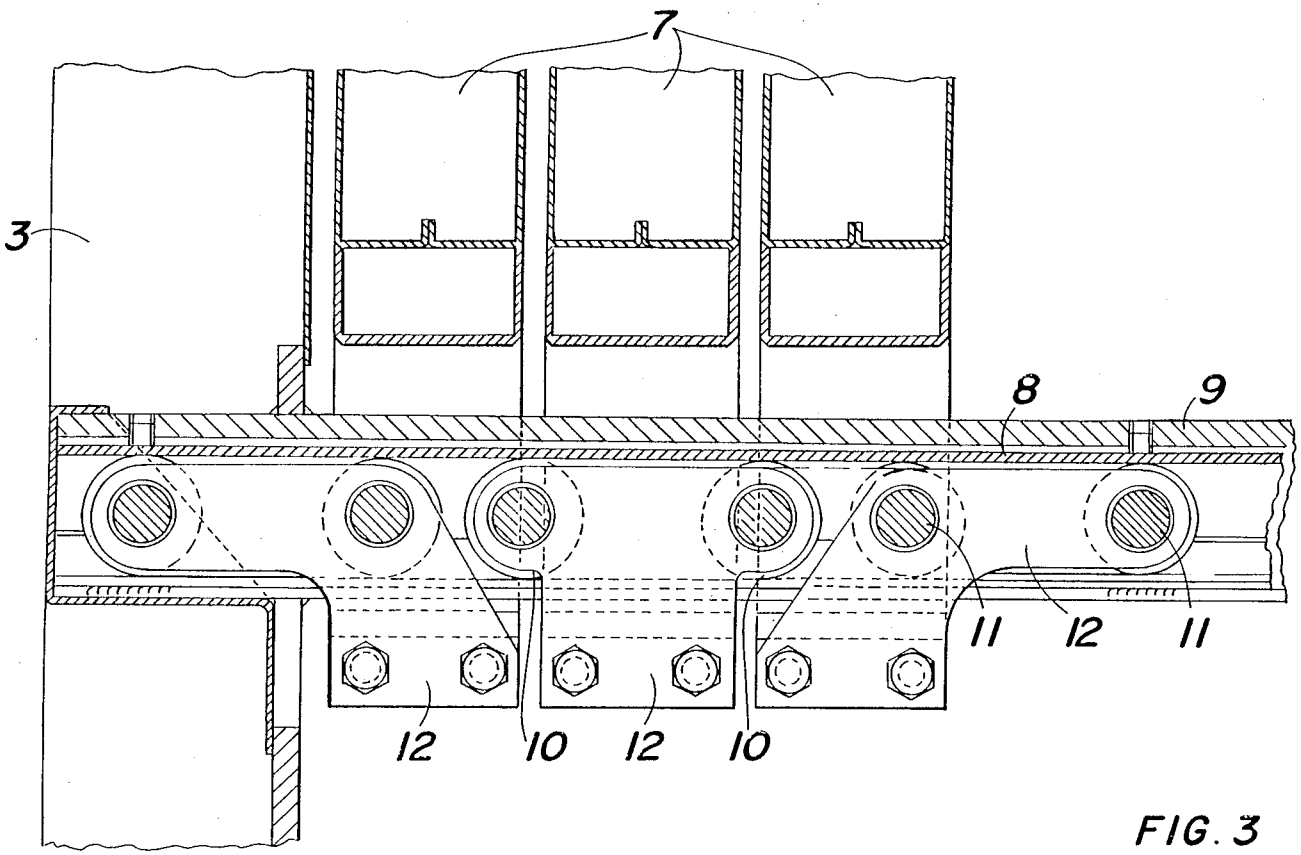
FIG. 3 is a sectional view according to the line III—III of FIG. 2.
Figure 4:
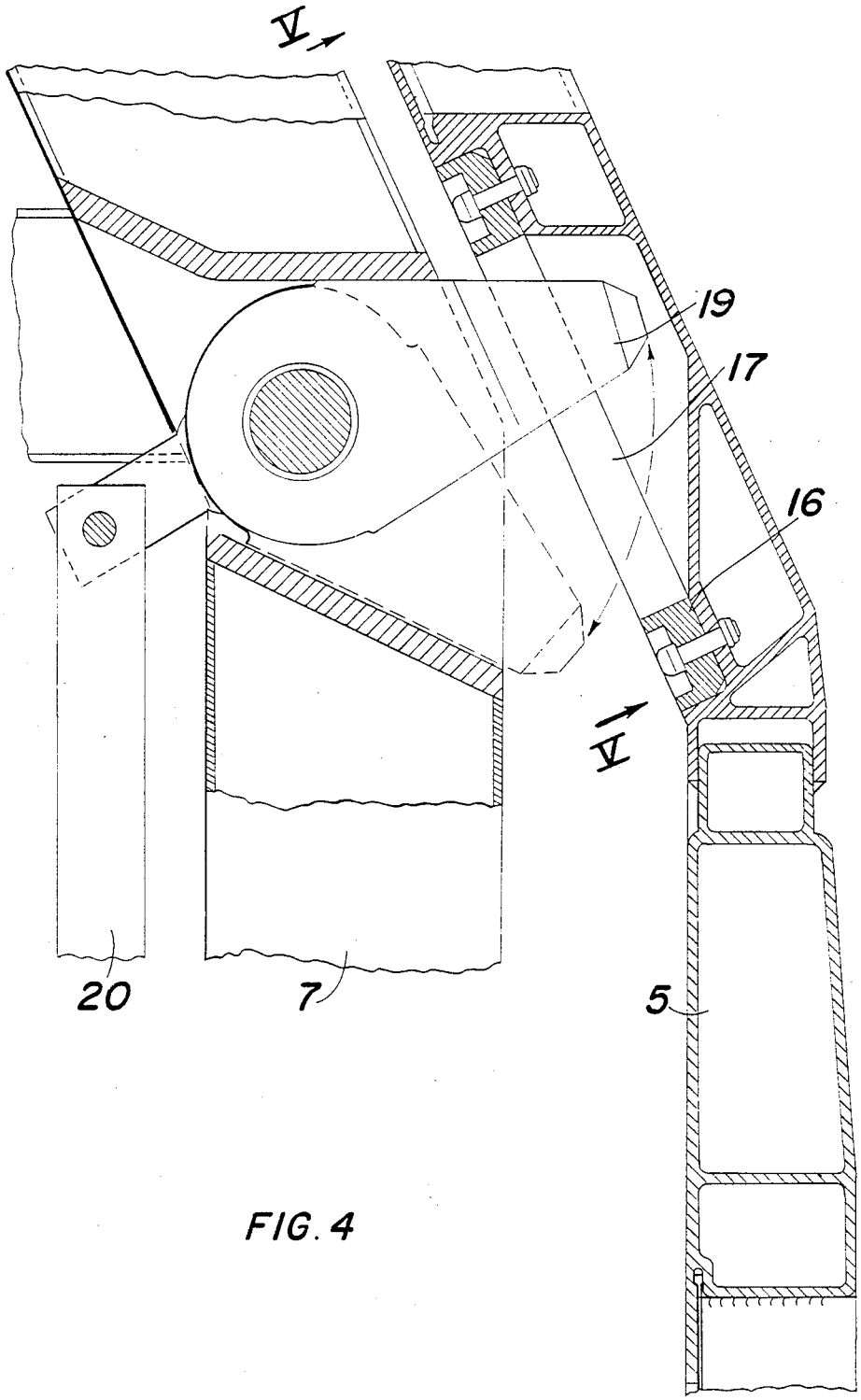
FIG. 4 is an enlarged view of the detail "B" of FIG. 1.
Figure 5:
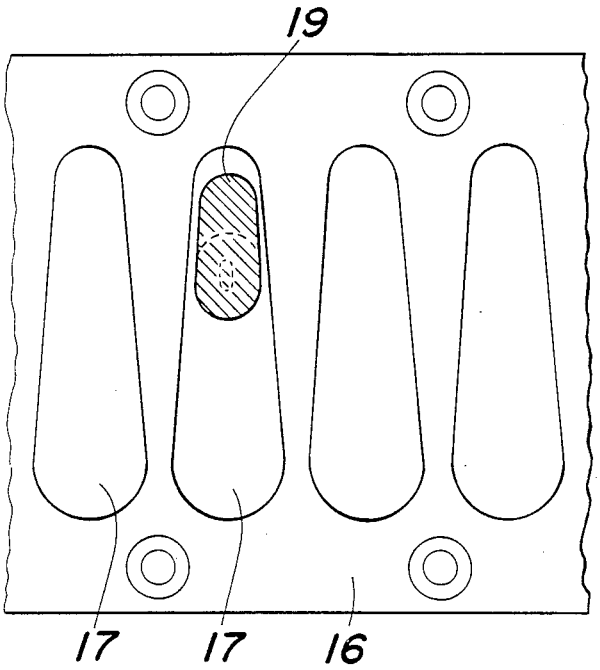
FIG. 5 is a sectional view according to the line V—V of FIG. 4.

Locking strips 16 are arranged on the inside of each hood 5 in the area which is reduced with regard to the lengthwise axis of the car. The locking strips 16 have vertical slots arranged next to one another in a row and spaced apart. The vertical slots have a conical shape, the tapered ends pointing upward. The separation walls 7 are fastened at the bottom by means of vertically slidable pegs 18 in the holes 15 of the punched strips 17 and at the top by means of swivelable locking cams or toe elements [toes] 19 which are pivotally mounted in the separation wall 7 engaging with the slots 17 of the locking strips 16. Herein, the locking cams 19 and the pegs 18 are connected by means of an actuating lever system 20 arranged inside the separation wall so that upon actuation of a handle 21, which can be retracted into the separation wall 7, the pegs 18 and the locking cams 19 can be moved simultaneously. A spring is interposed in the actuating lever system 20, which guarantees that the locking cam 19 is pushed down in the locked position and can therefore be swiveled into the unlocked released position without the peg 18 being disengaged from the punched strip 14. FIG. 4 and 5 show that the locking cam 19 is a double-sided lever and is swivelable around a horizontal axle 25 arranged in the separation wall in the lengthwise direction of the car, the end of the locking cam 19, which protrudes into the separation wall 7 being connected articulatedly with the actuating lever system 20 and the end of said locking cam 19 protruding laterally from the separation wall 7 tapering in conically and being adjusted laterally to the angle of the slot 17.

When loading the railroad freight car having one hood 5 opened, usually a first freight good stack is stapled or fixed, sitting close to an end wall 3. Then a separation wall 7 is slid against the freight good stack moving on rollers 10 in the rail 8. Herein the separation wall 7 is moved tilt-safely by means of the roller pairs of each rolling fixture arranged spaced a distance with regard to one another. Once the separation wall 7 touches the freight good stack, the peg 18 is inserted into a hole 15 of the punched strip 14 by actuating the actuating lever system 20 by means of the handle 21 and the separation wall 7 is locked at the bottom. Simultaneously, the locking cam 19 rotates or turns out from the separation wall 7. When the hood 5 is closed, it is lowered over the locking cam 19 with one of its slots 17 of the locking strip 16. The separation wall 7 is thus locked at the top. If upon closing of the hood 5 no slot 17 of the locking strip 17 is positioned directly over the locking cam 19, it is pressed down against the force of the spring arranged in the actuating lever system 20. When moving the railway freight with car and the consequent settling and slight movement forward of the load, the separation wall 7 moves slightly at the top. As soon as the locking cam 19 is located under the next slot 17 of the locking strip 16, it snaps automatically into said slot 17 by force of the spring in the actuating lever system 20. Now the separation wall 7 is also locked at the top. Due to the conical shape of the slots 17 and the free end of the locking cam 19 the hood 5 cannot get jammed with regard to the separation wall 7.

In the closed position each hood 5 is fixedly clamped to the respective end wall 3, the center portal 4 and the bogie 1, so that the forces acting upon the hood 5 can be transferred by the hood. As this design of the hood is not the subject of the present invention, however, it will not be discussed in detail.

While a specific embodiment of the invention has been shown and described in detail to illustrate the application of the principles of the invention, it will be understood that the invention may be embodied otherwise without departing from such principles.

What is claimed is:

1. A railroad freight car comprising:

a substantially level freight floor;

first and second end walls positioned at ends of said freight floor;

first and second hoods located in a common plane for covering said freight floor, said hoods cooperating with said end walls to define a freight room and each of said hoods having an apex with joints for pivoting out portions of said hoods and a sealing arrangement, said hoods including mounting means for allowing said hoods to be raised for displacement into a displacing position over one another, said hoods each including rollers, connectable with rails, said rails being mounted to said freight floor for depositing said hoods on said rails;

separation walls positioned within said freight room, each of said separation walls including separation wall rollers, said freight floor including first and second separation wall rails positioned on each side of a central area of said freight room said rollers being engageable with said rails and, separation wall arresting means including releasable pegs engageable with holes defined by said freight floor and swivelable locking cams for engagement with one of said hoods, said separation wall arresting means including means for engaging said releasable pegs with said peg holes and for swiveling said cams for engagement with one of said hoods.

2. A railroad freight car according to claim 1, wherein said freight floor includes C-profile side elements having a downward opening portion for reception of said separation wall rails.

3. A railroad freight according to claim 1, wherein each separation wall has a transverse end, a rolling fixture including rollers being connected to said transverse end of each separation wall, each rolling fixture having first and second axles running parallel to each other and spaced apart, each axle supporting two rollers, said axles being connected to a common axle holder, said axle holder being connected to said separation wall transverse end by an elastic element.

4. A railroad freight car according to claim 3, wherein three separation walls are positioned on each side of a central portal, the rolling fixture of the middle separation wall of said three separation walls having been arranged vertically and extending in the direction of the adjacent separation wall, the rolling fixtures of the outer separation walls of said three separation walls extending away from said middle separation wall.

5. A railroad freight car according to claim 1, wherein said hoods each include slots, said locking cams being engageable with said slots, said slots being formed by locking strips, said locking strips defining slots with upwardly directing pointed tapered portions.

6. A railroad freight car according to claim 1, wherein said peg holes are formed by punched strips arranged at a distance with regard to one other, said punched strips being positioned adjacent the C-profile elements adjacent the side of the freight floor.

7. A railroad freight car according to claim 1, wherein each of said pegs and said locking cams are actuated by actuation lever means including a handle positioned in an indented portion of each separation wall for moving an associated peg into one of said peg holes and swiveling said locking cam upward into a slot.

8. A railroad freight car according to claim 7, wherein each of said locking cams is swivelable about a horizontal axle connected to an associated separation wall, said locking cam and said horizontal axle defining a double-sided lever, a first side of said double-sided lever including a camming element positionable within said slot and a second side of said doublesided lever being connected to said actuating lever means.

9. A railroad freight car according to claim 7, wherein said actuating lever means further includes a spring arranged on said lever and biasing said locking cam into a locked position.

* * * * *